United States Patent [19]

Dziki

[11] Patent Number: 4,561,569

[45] Date of Patent: Dec. 31, 1985

[54] THERMOPLASTIC DISPENSING DEVICE WITH OUTLET COOLING CHAMBER

[75] Inventor: Michael M. Dziki, Woodbury, Minn.

[73] Assignee: Minnesota Mining and Manufacturing Company, Saint Paul, Minn.

[21] Appl. No.: 570,246

[22] Filed: Jan. 12, 1984

[51] Int. Cl.[4] ..... B67D 5/62

[52] U.S. Cl. ..... 222/146.5; 219/230

[58] Field of Search ..... 222/146.5, 146.2, 146.1, 222/325, 509, 568, 567, 174; 219/230, 421; 425/87, 458; 221/232; 239/526, 525; 126/343.5 A; 228/52, 53

[56] References Cited

U.S. PATENT DOCUMENTS

| | | | |
|---|---|---|---|
| 3,204,828 | 9/1965 | Paulson | 222/146 |
| 3,298,572 | 1/1967 | Newton | 222/146 |
| 3,788,522 | 1/1974 | Mercer | 222/568 X |
| 3,951,308 | 4/1976 | Thirtle | 222/146.5 X |
| 4,090,643 | 5/1978 | Wilkinson, Jr. | 222/146.5 |
| 4,457,457 | 7/1984 | Dziki | 222/146.5 |

FOREIGN PATENT DOCUMENTS

| | | | |
|---|---|---|---|
| 1092802 | 6/1981 | Canada | 222/568 |

*Primary Examiner*—Joseph J. Rolla
*Assistant Examiner*—David H. Bollinger
*Attorney, Agent, or Firm*—Donald M. Sell; James A. Smith; William L. Huebsch

[57] ABSTRACT

A device for dispensing molten thermoplastic material in which a solid block of thermoplastic material is pressed through a sleeve and into a heated melting chamber from which the molten thermoplastic material is discharged through a nozzle. A cooling assembly can be disposed between the melting chamber and the nozzle to provide means for substantially cooling the molten thermoplastic material (e.g., by 30° F.) which can be advantageous where the temperature of molten thermoplastic material in the melting chamber can become so high that it will damage certain substrates on which the molten material will be dispensed.

2 Claims, 5 Drawing Figures

THERMOPLASTIC DISPENSING DEVICE WITH OUTLET COOLING CHAMBER

TECHNICAL FIELD

This invention relates to devices for dispensing molten thermoplastic materials.

BACKGROUND ART

Many devices are known for dispensing molten thermoplastic materials, such as the devices described in U.S. Pat. Nos. 3,204,828 and 3,298,572.

Generally, such devices comprise a barrel member having an internal melting chamber which communicates with an outlet opening through a nozzle, and a sleeve with a through opening having one end secured to the barrel member with its through opening communicating with the end of the melting chamber opposite the nozzle. The sleeve is adapted to receive an elongate cylindrical block of solid thermoplastic material which fits closely within the through opening in the sleeve, with one end portion of the block in the melting chamber and the other end portion projecting through the sleeve. Means are provided for heating the barrel member to melt the end portion of the block therein, and means are provided for affording pressing the block through the sleeve and into the melting chamber to force molten thermoplastic material out of the melting chamber through the nozzle.

While such devices function effectively, certain problems can arise for the operator of such a device when he wishes to dispense molten thermoplastic material onto a substrate that will be damaged by molten thermoplastic material at the temperature that such molten thermoplastic material achieves in the melting chamber when molten thermoplastic is not dispensed from the device for a period of time while the means for heating the barrel remains activated. One example of such a problem is when molten thermoplastic at a temperature in the range of about 390°–400° Fahrenheit is applied to adhere expanded polystyrene to itself or other objects as is common in the florists trade, which will result in partial melting of the expanded polystyrene.

The thermostat in the device could be changed or could be made adjustable so that the temperature of the molten thermoplastic material in the melting chamber could be lowered to around 350° Fahrenheit which materials such as the expanded polystyrene can withstand. The former approach, however, is time consuming, the latter approach adds greatly to the cost of the device, and both approaches result in a device with less melting capacity than may be desired after the temperature is lowered.

Also, a large amount of adhesive may be dispensed through the device to lower the temperature of the adhesive being dispensed to a more acceptable level due to a limited dwell time in the melting chamber. With this approach, however, a large amount of the initially dispensed adhesive is too hot for use and must be wasted.

DISCLOSURE OF THE INVENTION

The present invention provides a simple, inexpensive and effective means for lowering the temperature of adhesive that will be dispensed from a device of the type described above below the temperature achieved in the melting chamber when molten thermoplastic has not been dispensed from the device for a period of time while the means for heating the barrel remains activated, which means can be easily added to or removed from the device as needed and does not affect the melting capacity of the device when it is in use.

The device according to the present invention for dispensing molten thermoplastic material is of the type comprising a barrel member mounted on a frame for the device and having an internal melting chamber communicating with an outlet opening through a nozzle, a sleeve with a through opening having one end secured to the barrel member with its through opening communicating with the end of the melting chamber opposite the outlet opening, which sleeve is adapted to receive a block of solid thermoplastic material with one end portion of the block in the melting chamber and the block projecting through said sleeve. Means are provided for heating the barrel member to melt the end portion of the block therein, and means are provided for affording pressing of the block through the sleeve and into the melting chamber to force molten thermoplastic material out the outlet opening. The improvement in such a device provided by the present invention is that heat conductive wall means defining a cooling chamber having a volume at least as great as the volume of the melting chamber is positioned between the barrel member and the nozzle. The conductive wall means have a peripheral surface area to transverse cross sectional area ratio that provides more heat radiation from the wall means than heat conduction from the barrel member so that the molten thermoplastic material in the melting chamber will be substantially cooled (e.g., by 30° Fahrenheit degrees) below the temperature of molten material that has remained in the melting chamber for a period of time but still remains molten so that it can be easily dispensed when needed.

Preferably the wall means is in the form of a cooling assembly that can be inserted between the nozzle and barrel member when molten thermoplastic material at a lower temperature is desired, and can be removed when higher temperature molten thermoplastic material is desired.

BRIEF DESCRIPTION OF THE DRAWING

The present invention wll be further described with reference to the accompanying drawing wherein like numbers refer to like parts in the several views, and wherein.

BRIEF DESCRIPTION OF THE DRAWING

Figure 1:
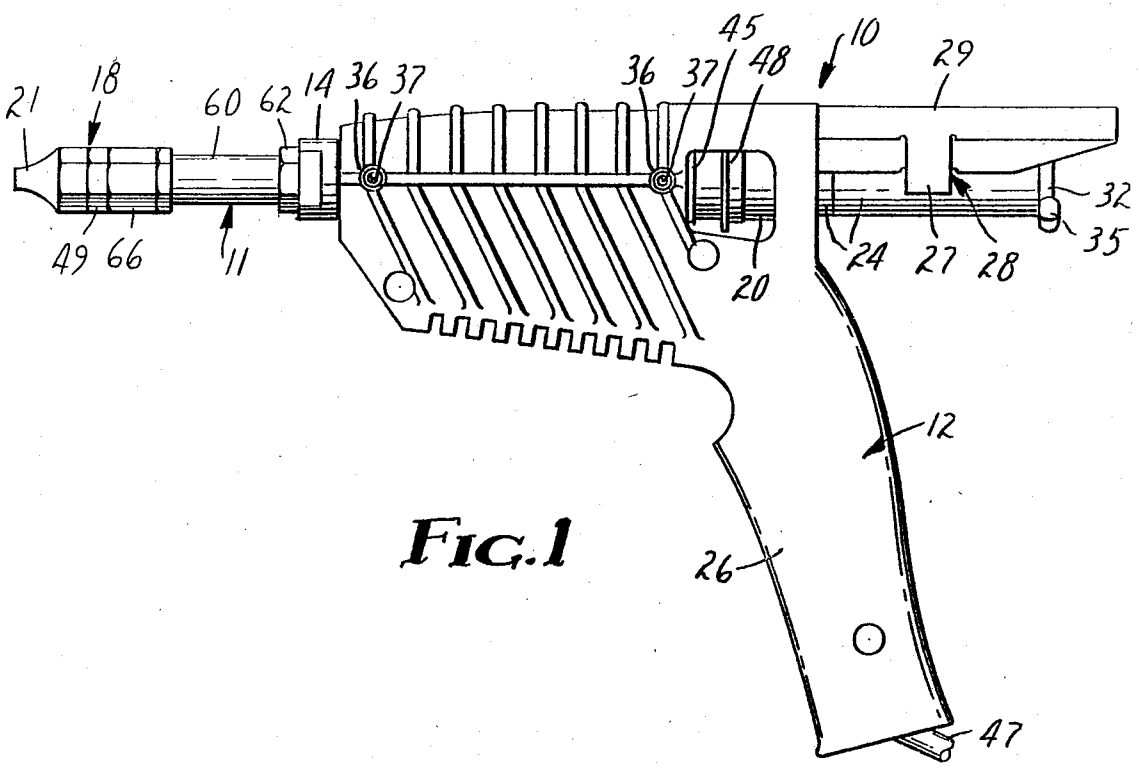
FIG. 1 is a side view of a dispensing device according to the present invention.
Figure 2:
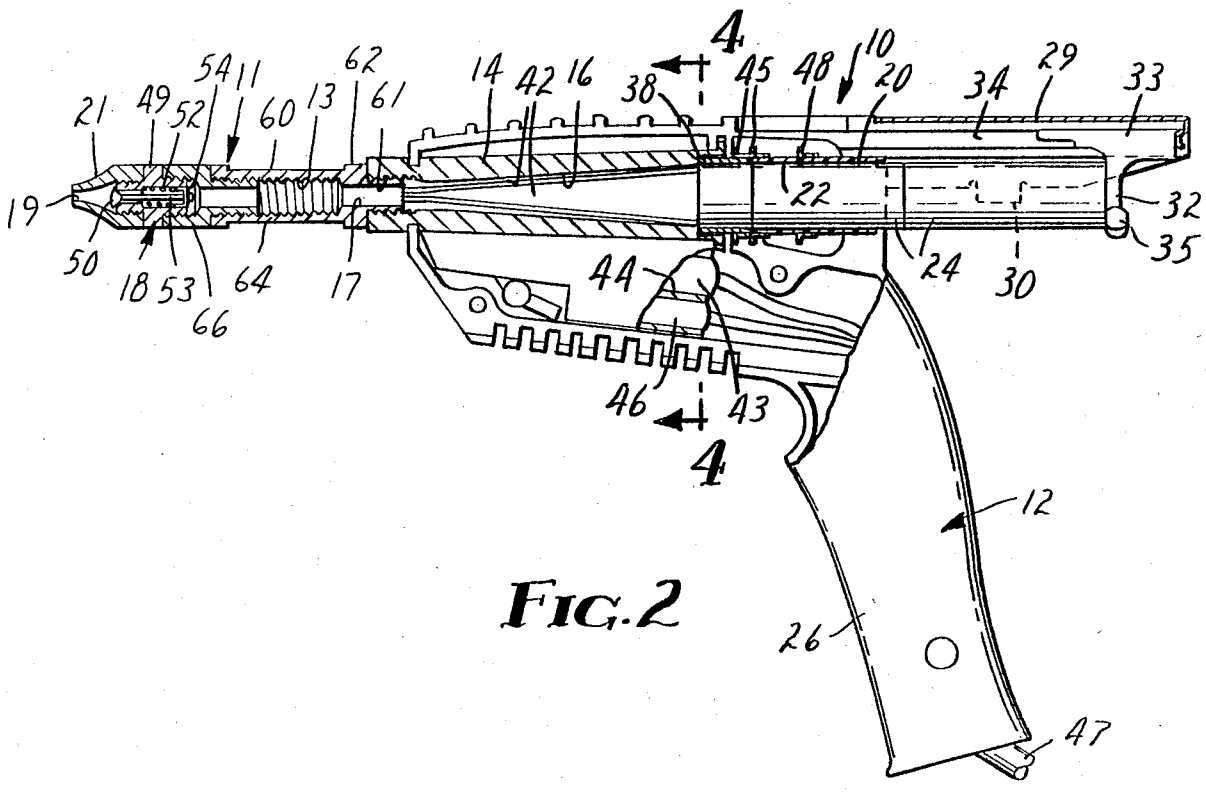
FIG. 2 is a sectional side view of the dispensing device of FIG. 1.
Figure 4:
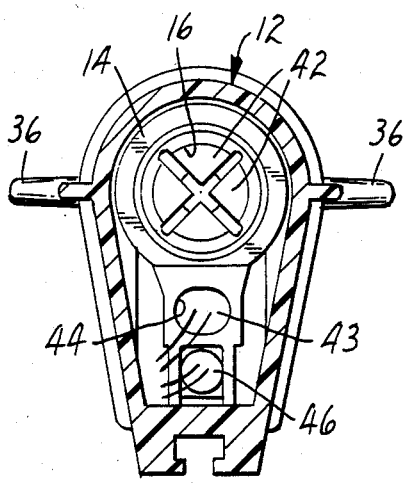
FIG. 4 is an enlarged sectional view taken approximately along lines 4—4 of FIG. 2.
Figure 5:
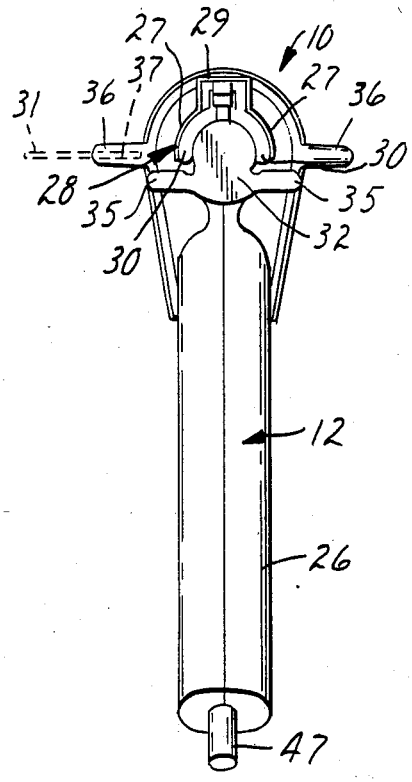
FIG. 5 is an end view of the dispensing device of FIG. 1.
Figure 3:
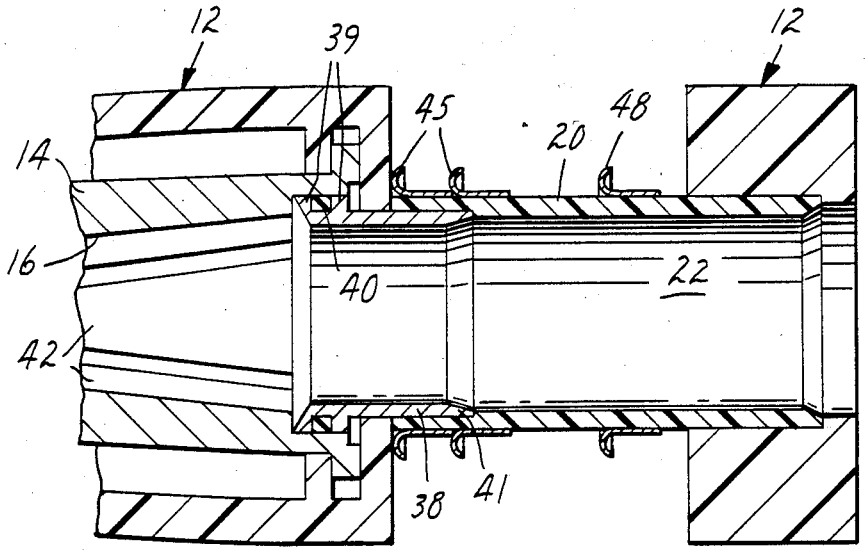
FIG. 3 is an enlarged fragmentary sectional view of a barrel member, a sleeve, and a barrier ring therebetween in the dispensing device of FIG. 1.

Referring now to the drawing there is shown in FIGS. 1 through 5 a dispensing device 10 for molten thermoplastic material including a cooling assembly 11 according to the present invention, which device 10, except for the addition of the cooling assembly 11 which provides wall means for defining a cooling chamber 13 for molten thermoplastic material to be dispensed from the device 10, is the same as the device 10 described in my U.S. patent application Ser. No. 456,346, filed Jan. 7, 1983, and the same reference numerals have been used for parts in this application that are identical to parts in that application.

Like the dispensing device for thermoplastic material described in my U.S. patent application Ser. No. 456,346, the dispensing device 10 comprises a two part frame 12, a barrel member 14 mounted between the parts of the frame 12 and having an internal melting chamber 16 communicating via a discharge passageway 17 through the cooling assembly 11 and a valve assembly 18 with an outlet opening 19 through a nozzle 21, and a sleeve 20 with a cylindrical through opening 22 having one end secured to the barrel member 14 with its through opening 22 communicating with the end of the melting chamber 16 opposite the discharge passageway 17. The sleeve 20 is adapted to receive a cylindrical block 24 of solid thermoplastic material within the cylindrical through opening 22 with a slight clearance fit even when the diameter of the block 24 is at the large end of its tolerance range, with one end portion of the block 24 in the melting chamber 16 and the block 24 projecting through the opening 22 in the sleeve 20. Means are provided in the device 10 for heating the barrel member 14 to melt the end portion of the block 24 therein. The frame 12 includes a handle 26 positioned so that an operator can grip the handle 26 with the fingers of one hand while applying pressure with the thumb of that hand to press the block 24 through the sleeve 20 and into the melting chamber 16 and force molten thermoplastic material out of the melting chamber 16 through the cooling assembly 11, the valve assembly 18 and the nozzle 21.

The device 10 further includes a bracket assembly 28 at the end of the sleeve 20 opposite the barrel member 14, which bracket assembly 28 includes means adapted for receiving and for holding a second block 24 of solid thermoplastic material in aligned end-to-end relationship with the block 24 of thermoplastic material in the sleeve 20 while affording the application of force by the thumb of an operator on the end of the block 24 opposite the sleeve 20 to press the second block 24 through the sleeve 20 and into the melting chamber 16. As illustrated, the bracket assembly 28 comprises spaced opposed gripping parts 30 of the frame 12 (FIG. 5) that project toward the handle 26 in a position spaced from the outer end of the sleeve 20 and on opposite sides of an extension of the axis for the sleeve 20. The gripping parts 30 are biased toward each other by spring means comprising a channel-like member 29 of spring steel engaged around the top surfaces of the two parts of the frame 12 to help hold the two parts of the frame 12 together, and having opposed arcuate projecting portions 27 that are biased against the outer surfaces on the gripping parts 30 of the frame 12. The gripping parts 30 have distal ends spaced at a distance that is less than the diameter of the cylindrical block 24 of thermoplastic material, but which distance is sufficient so that the block 24 can be transversely pressed therebetween to resiliently move the gripping parts 30 away from each other in opposition to the biasing of the projecting portions 27 and afford movement of the block 24 therebetween. Also, the gripping parts 30 have concave opposed inner surfaces adapted to conform to and engage the cylindrical side surfaces of a block 24 of thermoplastic material therebetween to hold the block 24 in alignment with a block 24 in the sleeve 20, while affording axial sliding movement of the block 24 and movement of the thumb of the operator between the gripping parts 30 to move the second block 24 into the sleeve 20.

The device 10 also comprises a pressure plate 32 adapted to abut the end of the outermost block 24 of thermoplastic material opposite the melting chamber 16 and to the positioned between the block 24 and the user's thumb to transfer force therebetween. The plate 32 includes an elongate slide portion 33 (FIG. 2) at one edge slideably mounted in a track 34 defined between the parts of the frame 12 to afford movement of the plate 32 with the block 24 and is shaped to pass between the gripping parts 30 so that the plate 32 can be used to push the block 24 fully into the sleeve 20 while directing forces applied to the plate 32 in the longitudinal direction of the block 24, and protects an operator's thumb from contact with the thermoplastic block 24 and from contact with any molten thermoplastic material that (under unusual conditions) might extrude to the outer end of the sleeve 20. The pressure plate 32 includes two wing portions 35, one projecting from each side, which wing portions 35 are positioned to pass under the gripping parts 30 as the pressure plate 32 is used to press the block 24 into the sleeve 20, and either of which wing portions 35 can be manually engaged to move the pressure plate 32 away from the sleeve 20 to facilitate placing a new block 24 of thermoplastic material between the gripping parts 30 after a previous block 24 has been pushed into the sleeve 20.

The two parts of the frame 12 are molded of a suitable high-temperature resistant polymeric material (e.g., the material commercially designated Dupon, Zytel FR50-NC10 available from E. I. DuPont deNemours, Wilmington, Del.). Both parts of the frame 12 are formed with spaced posts 36 projecting generally radially outwardly of the barrel member 14, which posts 36 can provide means for spacing the major side surface of the frame 12 and the nozzle 21 of the device 10 from a horizontal surface on which the device 10 is laid, and which posts 36 have sockets 37 adapted to receive end portions of a generally U-shaped wire 31 (FIG. 5) to further space the device 10 away from such a surface should that be desired.

The sleeve 20 is made of a stiff heat-resistive polymeric material (e.g., Teflon®) made by an extrusion process to provide a polished inner surface with microscopic longitudinally extending scratches that facilitates movement of the thermoplastic material through the sleeve 20, particularly after molten thermoplastic has cooled in the sleeve 20 and is again heated by the device 10.

The sleeve 20 is coupled to the barrel member 14 by a metal barrier ring 38 (FIGS. 2 and 3) that is heated by the means for heating the barrel member 14, which barrier ring 38 provides means for restricting the extrusion of molten thermoplastic material between the block 24 and the inner surface of the sleeve 20. The inlet barrier ring 38 is a generally cylindrical member having axially spaced radically outwardly projecting ribs 39 at one end positioned in a cylindrical socket in the end of the barrel member 14, between which ribs 39 is a sealing strip 40 pressed between the barrier ring 38 and barrel member 14 to provide a seal therebetween. An end portion 41 of the barrier ring 38 opposite the barrel member 14 is press fit into an internally relieved area of the sleeve 20. The barrier ring 38 has a cylindrical inside surface that is smaller in diameter than the inside diameter of the sleeve 20 (which sleeve 20 is adapted to always receive a block 24 with a slight clearance fit even when the diameter of the block 24 is at the upper end of its tolerance limits) so that the barrier ring 38 will receive a block 24 having a diameter at the upper end of its tolerance limits with a slight interference fit (e.g., an interference of up to 0.025 cm) or will receive a block 24 having a diameter at the lower end of its tolerance range with a clearance fit of about 0.050 cm. Surprisingly those blocks 24 with a diameter that provides such a slight interference fit with the barrier ring 38 will be melted sufficiently around their periphery by the heated barrier ring 38 that they can be easily pressed into the melting chamber 16, and blocks 24 of thermoplastic material with diameters that provide either such slight interference fits or clearance fits fit sufficiently close in the barrier ring 38 so that no significant amount of molten polymeric material will extrude out of the melting chamber 16 between the block 24 and the barrier ring 38 and toward the outer end of the sleeve 20 between the block 24 and the sleeve 20.

The device 10 also includes three metal (preferably brass) cooling flanges around the outer periphery of the sleeve 20 that provide means for developing predetermined temperature zones in the sleeve 20, including two closely spaced regulating flanges 45 at the end of the sleeve 20 adjacent the barrier ring 38 which cool and regulate the temperature of the molten thermoplastic material in the area between the barrier ring 38 and the sleeve 20, and a cooling flange 48 about centered along the length of the sleeve 20 that cools the sleeve 20 to restrict the thermoplastic material from becoming molten past that area along the sleeve 20, even if the heating means is activated for a long period of time during which molten thermoplastic material is not being dispensed from the device 10.

The barrel member 14 is of a suitable metal (e.g,, aluminum). The melting chamber 16 in the barrel 14 is defined by a generally frustroconical inner surface tapered toward the valve assembly 18 to direct the molten polymeric material to the discharge passageway 17 and four equally spaced radially inwardly projecting ribs 42 which provide heated contact surfaces in addition to the frustroconical inner surface for engaging and melting the blocks 24 of thermoplastic material as they are pressed into the chamber 16. An electric heating element 43 which heats both the barrel member 14 and the barrier ring 38 is positioned in a socket 44 in the barrel member 14 beneath the chamber 16, and a thermostat 46 is fixed in a channel below the heating element 43 to disconnect electrical power normally supplied the heating element 43 via a power cord 47 and the thermostat 46 when the temperature of the barrel member 14 at the thermostat 46 exceeds a predetermined maximum (e.g., 200° C. or 400° F.).

The cooling assembly 11, which is the primary subject matter of this application, comprises an elongate conductive metal (e.g., aluminum) sleeve 60 having a through opening including a relatively small diameter inlet opening portion through an externally threaded part of the sleeve 60 adapted to engage the end of the barrel member 14 and an adjacent part 62 of the sleeve 60 with an octagonal periphery by which the sleeve 60 can be engaged with or disengaged from the barrel member 14. Also the sleeve 60 includes a major part having a thin cylindrical wall 64 which has a cylindrical periphery and is threaded along its entire inner surface to both provide means to receive an adapter nut 66 with a through opening that fits between the sleeve 60 and the valve assembly 18, and to further reduce the cross sectional area of the thin cylindrical wall 64. The cooling chamber 13 is defined by the cylindrical wall 64 of the sleeve 60 adjacent the adapter nut 66 and has at least the same volume as the melting chamber 16 so that adhesive will have sufficient dwell time in the cooling chamber 13 to dissipate some of its heat. Also the cooling assembly 11 has a peripheral surface area to transverse cross sectional area ratio such that the cooling assembly 11 has more heat radiation from its peripheral surface than heat conduction along its length from the barrel member to result in cooling of the molten thermoplastic material in the cooling chamber 13.

As a non-limiting example, an aluminum sleeve 60 as shown with a this wall 64 having an O.D. of about 1.4 cm (0.56 inch), and being internally threaded with a ¼-20 thread which defines a cooling chamber 13 having a length of about 2.8 cm (1.1 inch) can effectively cool molten thermoplastic material by about 30 Fahrenheit degrees (e.g., to about 350° F. in cooling chamber 13 when the temperature in the melting chamber 16 is about 390°–400° F.).

The valve assembly 18 between the cooling assembly 11 and the nozzle 21 provides valve means for restricting molten thermoplastic material from running out of the nozzle 21 until a predetermined amount of force (e.g., about 0.9 to 1.8 kilograms) is manually applied to the block 24 of thermostatic material 24 to cause pressure in the molten thermoplastic material in the melting chamber 16 and cooling chamber 13. The valve assembly 18 is of the poppet valve type and includes a valve body 49 secured between the cooling assembly 11 and nozzle 21, which valve body 49 helps define the discharge passageway 17 communicating between the melting chamber 16 and the opening 19 through the nozzle 21. The portion of the discharge passageway 17 through the valve body 49 is normally closed by a head 50 on a valve normally biased against a valve seat on the end of the valve body 49 adjacent the nozzle 21 by a spring 52 compressed between a flange on the valve body 49 and a perforated retaining disk 54 fixed on a stem 53 of the valve, which disk 54 is axially slidably mounted in the valve body 49. Pressure from molten thermoplastic material in the melting chamber 16 and discharge passageway 17 caused by pressure manually applied to the block 24 of thermoplastic material can move the valve head 50 away from its seat against the bias of the spring 52 and allow molten thermoplastic material to pass the valve head 50 and be discharged through the nozzle 21. When the operator releases such pressure, however, the valve head 50 will again move to its seat under the influence of the spring 52 to prevent any more molten thermoplastic material within the melting chamber 16 and discharge passageway 17 from escaping through the nozzle 21.

To use the dispensing device 10, an operator first connects the power cord 47 to a source of electrical power so that the barrel member 14 and barrier ring 28 are heated by the heating element 43. The operator then places the block 24 of thermoplastic material in the opening 22 through the sleeve 20, grabs the handle 26 with one hand, and uses the thumb of that hand to press against the pressure plate 32 to slide it along the track 34 into engagement with the block 24 and thereby press the block 24 through the sleeve 20 and barrier ring 38 and into the melting chamber 16 in the barrel member 14 where the end portion of the block 24 will be made molten by contact with the inner surface of the barrel member 14, including the inwardly projecting ribs 42. While the inner surface of the sleeve 20 will provide a clearance fit with the periphery of the block 24, even if the diameter of the block 24 is at the upper limit of its tolerance range, the barrier ring 38 has a cylindrical inner surface with a slightly smaller inner diameter than the inner diameter of the sleeve 20 and will provide a slight interference fit or a very close clearance fit with the block 24, depending on whether the diameter of the block 24 is at the upper or lower limit of its tolerance range. If there is an interference fit, the barrier ring 38 will melt the periphery of the thermoplastic block 24 sufficiently to allow it to easily pass; and in either event the barrier ring 38 will greatly restrict extrusion of thermoplastic material from the melting chamber 16 back between the block 24 and the barrier ring 38 and thus between the block 24 and the inner surface of the sleeve 20. Sufficient pressure in the molten thermoplastic within the melting chamber 16 and cooling chamber 13 caused by manual pressure on the pressure plate 32 and block 24 will cause the head 50 of the value to move away from its value seat against the bias of the spring 52 so that the molten thermoplastic can flow around the head 50 and out the outlet opening 19 of the nozzle 21. When manual pressure is released on the pressure plate 32, the head 50 will again move to its seat under the influence of the spring 52 which stops the flow of molten material through the nozzle 21 and restricts air from reaching the molten thermoplastic material in the cooling and melting chambers 13 and 16, thereby restricting oxidation of the molten thermoplastic therein.

If the heating element 43 remains activated for a long time while no molten thermoplastic material is dispensed through the nozzle 21, heat buildup can cause the temperature of the molten thermoplastic material in the melting chamber 16 to reach a temperature approaching the maximum temperature achieved by the barrel member 14 when it is heated (e.g., 400° F.) which may be too hot for use on some substrates. The cooling assembly 11, however, allows more heat to radiate from its periphery than is conducted into it from the barrel member 14 so that the molten thermoplastic material in its cooling chamber 13 is substantially cooler (e.g., 350° F.) and thus may not damage such a substrate when it is applied. If desired, of course, the cooling assembly 11 may be removed and the valve assembly 18 attached directly to the barrel member 14 as is shown in my patent application Ser. No. 343,304 so that the higher temperature thermoplastic material may be dispensed.

When the outer end of the block 24 of thermoplastic material reaches the outer end of the sleeve 20, the operator can manually retract the pressure plate 32 along its track 34 via one of the wing portions 35 and press a new block 24 of thermoplastic material transversely between the gripping parts 30 of the holding bracket 28, whereupon the new block 24 will be held in proper alignment with the sleeve 20, and the operator can again use the pressure plate 32 to press the new block 24 into the melting chamber 16.

The present invention has now been described with reference to one embodiment thereof. It will be apparent to those skilled in the art that many changes can be made in the embodiment described without departing from the scope of the present invention. For example, the sleeve 60 could be formed with spaced circumferential or longitudinally extending fins to help in radiation cooling of molten liquid in the cooling chamber 13 so long as the fins are sized, positioned and spaced so that more radiation cooling than conduction from the barrel member 14 is provided. Also, the cooling assembly 11 or a similar structure can be used with devices through which molten thermoplastic material is dispensed of the type described in this application or in the prior art noted above, or the type described in my U.S. patent application Ser. No. 343,304 filed Jan. 27, 1982 now U.S. Pat. No. 4,457,457. Thus the scope of the present invention should not be limited to the structure described in this application, but ony by structures described by the language of the claim and their equivalents.

What is claimed is as follows:

1. In a device for dispensing molten themoplastic material comprising a frame, a barrel member mounted on said frame and having an internal melting chamber communicating with an outlet opening through a nozzle, a sleeve with a through opening having one end secured to said barrel member with said through opening communicating with the end of said melting chamber opposite said outlet opening, said sleeve being adapted to receive a block of solid thermoplastic material with one end portion of the block in the melting chamber and the block projecting through said sleeve, means for heating said barrel member to a predetermined temperature to melt the end portion of the block therein, and means for affording pressing of the block through the sleeve and into the melting chamber to force molten thermoplastic material out said outlet opening, the improvement wherein:

said device further includes a heat conductive wall defining a cooling chamber having a volume at least as great as the volume of said melting chamber removably positioned between said barrel member and said nozzle, said conductive wall having a peripheral surface area of transverse cross sectional area ratio that provides more heat radiation from said wall than heat conduction from said barrel member so that when molten thermoplastic material is not being dispensed, said heat conductive wall produces a molten thermoplastic temperature in said cooling chamber of at least 30 Fahrenheit degrees less than the molten thermoplastic temperature in said melting chamber.

2. A cooling assembly adapted for use in a device for dispensing molten thermoplastic material, which device is of the type comprising a frame, a barrel member mounted on said frame and having an internal melting chamber communicating with an outlet opening through a nozzle, a sleeve with a through opening having one end secured to said barrel member with said through opening communicating with the end of said melting chamber opposite said outlet opening, said sleeve being adapted to receive a block of solid thermoplastic material with one end portion of the block in the melting chamber and the block projecting through said sleeve, means for heating said barrel member to a predetermined temperature to melt the end portion of the block therein, and means for affording pressing of the block through the sleeve and into the melting chamber to force molten thermoplastic material out said outlet opening, said cooling assembly comprising a heat conductive wall defining a cooling chamber having a volume at least as great as the volume of the melting chamber of a said device and being adapted to be removably inserted between its barrel member and nozzle, said conductive wall having a peripheral surface area to transverse cross sectional area ratio that can provide more heat radiation from said wall than heat conduction from the barrel member of the device so that when molten thermoplastic material is not being dispensed, said heat conductive wall produces a molten thermoplastic temperature in said cooling chamber of at least 30 Fahrenheit degrees less than the molten thermoplastic temperature in said melting chamber.

* * * * *